US011203053B2

(12) United States Patent
Newar

(10) Patent No.: US 11,203,053 B2
(45) Date of Patent: Dec. 21, 2021

(54) PERIPHERAL COMBINATION HYDRAULIC PRESS TO FORGE AND METHOD OF MANUFACTURING THEREOF

(71) Applicant: Shyam Newar, Kolkata (IN)

(72) Inventor: Shyam Newar, Kolkata (IN)

( * ) Notice: Subject to any disclaimer, the term of this patent is extended or adjusted under 35 U.S.C. 154(b) by 95 days.

(21) Appl. No.: 16/824,755

(22) Filed: Mar. 20, 2020

(65) Prior Publication Data

US 2021/0101203 A1 Apr. 8, 2021

(30) Foreign Application Priority Data

Oct. 3, 2019 (IN) ..... 201931039930
Jan. 28, 2020 (WO) ..... PCT/IN2020/000004

(51) Int. Cl.
*B21J 7/14* (2006.01)
*B21J 9/18* (2006.01)
*B21J 13/02* (2006.01)

(52) U.S. Cl.
CPC . *B21J 7/14* (2013.01); *B21J 9/18* (2013.01); *B21J 13/025* (2013.01)

(58) Field of Classification Search
CPC ..... B21J 5/008; B21J 7/14; B21J 9/18; B21J 9/025; B21J 13/04; B21J 13/025; B21J 9/027; B21J 7/145; B21J 7/16
See application file for complete search history.

(56) References Cited

U.S. PATENT DOCUMENTS 720,052 A * 2/1903 McKibben ..... B21J 7/16 72/76
804,542 A * 11/1905 Loss ..... B21J 9/027 72/331

(Continued)

FOREIGN PATENT DOCUMENTS

AU 2002242478 B2 9/2005
CN 106671461 A 5/2017

(Continued)

OTHER PUBLICATIONS

Vid-1: Screen captures from YouTube video clip entitled "Automatic Radial and Axial Ring Rolling Machine" 3 pages, uploaded Jul. 20, 2015 by user Arvind Gaur /G7 Consultant. Retrieved from Internet: <https://www.youtube.com/watch?v=ya14-KuNMQQ>.

(Continued)

*Primary Examiner* — Gregory D Swiatocha
(74) *Attorney, Agent, or Firm* — Dominic A. Frisina

(57) ABSTRACT

A radial forge is provided with variable radial displacement. The forge includes upper and lower frames having upper and lower double acting hydraulically driven rams. The forge also includes a horizontal master gear mounted on a circular thrust bearing to provide rotational freedom. One or more radial hydraulically drive rams are mounted to the master gear. Accordingly, the master gear serves as a gantry for positioning the radial rams. A billet may be centrally located between the inwardly directed radial rams and may be supported by the lower ram. The upper ram is aligned with the lower ram so that actuating the upper ram and/or lower ram compresses the billet between them and forces the billet to flow into and fill radial dies removably affixed to the radial rams.

11 Claims, 14 Drawing Sheets

(56) References Cited

U.S. PATENT DOCUMENTS

| | | | | |
|---|---|---|---|---|
| 2,793,548 | A * | 5/1957 | Kralowetz | B21J 7/14 72/20.4 |
| 3,135,139 | A * | 6/1964 | Kralowetz | B21J 7/14 72/76 |
| 3,638,471 | A * | 2/1972 | Martin | B21J 5/008 72/377 |
| 3,834,214 | A * | 9/1974 | Kralowetz | B21J 7/14 72/407 |
| 3,999,417 | A | 12/1976 | Orain | |
| 4,420,962 | A | 12/1983 | Peterson | |
| 4,766,808 | A | 8/1988 | Schrock | |
| 4,954,068 | A | 9/1990 | Brussel | |
| 4,996,863 | A | 3/1991 | Keeler | |
| 5,747,073 | A | 5/1998 | Pettersson et al. | |
| 5,787,753 | A | 8/1998 | Dougherty | |
| 5,868,026 | A | 2/1999 | Sarkisian et al. | |
| 6,070,446 | A * | 6/2000 | Blaimschein | B21J 7/145 72/76 |
| 6,129,793 | A | 10/2000 | Tan et al. | |
| 6,240,765 | B1 | 6/2001 | Delgado et al. | |
| 6,519,998 | B2 | 2/2003 | Ertl et al. | |
| 6,723,277 | B1 | 4/2004 | Kurz et al. | |
| 7,043,806 | B2 | 5/2006 | Schrock et al. | |
| 7,082,809 | B2 | 8/2006 | Balasu | |
| 7,117,598 | B2 | 10/2006 | Prucher | |
| 7,954,426 | B2 | 6/2011 | Murphy et al. | |
| 8,381,645 | B2 | 2/2013 | Hejplik | |
| 9,821,359 | B2 | 11/2017 | Niaraki et al. | |
| 9,956,611 | B2 | 5/2018 | Sterkenburg | |
| 2005/0223915 | A1 | 10/2005 | Van Der Beek et al. | |
| 2005/0252269 | A1 | 11/2005 | Sawdon et al. | |
| 2007/0125148 | A1 | 6/2007 | Dohmann et al. | |
| 2015/0128419 | A1 | 5/2015 | Ozeki et al. | |
| 2017/0095988 | A1 | 4/2017 | Rauschenberger | |
| 2017/0320126 | A1 | 11/2017 | Cibecchini et al. | |

FOREIGN PATENT DOCUMENTS

| | | | |
|---|---|---|---|
| CN | 207697103 | U | 8/2018 |
| EP | 1073556 | B1 | 7/2001 |
| GB | 157583 | A | 1/1921 |
| GB | 717163 | A | 10/1954 |
| GB | 754495 | A | 8/1956 |
| GB | 1462665 | A | 1/1977 |
| JP | 2018012138 | A | 1/2018 |
| MD | 3862 | G2 | 3/2009 |
| WO | 1990009274 | A1 | 8/1990 |
| WO | 2007110736 | A3 | 10/2007 |
| WO | 2016075643 | A1 | 5/2016 |

OTHER PUBLICATIONS

Vid-2: Screen captures from YouTube video clip entitled "Gear Forging", 5 pages, uploaded Oct. 12, 2016 by user Arvind Gaur /G7 Consultant. Retrieved from Internet: <https://www.youtube.com/watch?v=QcntQ8INPAw>.

Vid-3: Screen captures from YouTube video clip entitled "Crown Gear Forging", 9 pages, uploaded Nov. 22, 2016 by user Arvind Gaur /G7 Consultant. Retrieved from Internet: <https://www.youtube.com/watch?v=qx0NY6nu4Sw>.

* cited by examiner

PERIPHERAL COMBINATION HYDRAULIC PRESS TO FORGE AND METHOD OF MANUFACTURING THEREOF

I. BACKGROUND OF THE INVENTION

A. Field of Invention

Embodiments of the invention generally relate to radial near-net forging.

B. Description of the Related Art

Forging is a method of forming ferrous and nonferrous metals to a predetermined shape using a hammering or pressing action. Hydraulic forges can be generally categorized as open die or closed die, where at least one of the dies is mounted to hydraulically driven platens. In an open die arrangement, the work piece is not enclosed by the die. In fact, an open die can be nothing more than a flat plate of tool steel. In contrast to an open die, a closed die fully encloses the workpiece in the nature of a mold and forces the workpiece to flow under heat and pressure, filling the die. Grain boundaries take on a preferred orientation in the direction of flow, aligning to form a crystallographic texture that adds strength to the workpiece. In general, the greater the flow, the greater the grains' tendency to align. Accordingly, the grain texture is strongest where the material experiences the greatest flow, which tends to be near the surface. As a result, the benefits conferred by a crystallographic texture can be lost if the workpiece must be machined after forging, because machining tends to remove the strongest texture.

Near-net forging helps to address this problem. Particularly, a near-net forging process results in a workpiece that requires minimal, if any, machining. Thus, the crystallographic texture is preserved. In a near-net shape forge using a closed die, a heated metal blank is placed in the lower die, and the upper and lower dies are pressed together by action of an upper hydraulically driven platen. This arrangement has certain inherent limitations. For example, a crane wheel with a circumferential groove would not be removable from such a die because the die must extend into the groove. Known methods of radial forging do not solve this problem, as they either suffer from the removability problem or are not conducive to near-net forging.

Thus, what is missing in the art is a hydraulic closed-die radial forge where the die has variable radial displacement and produces net shape or near-net shape workpieces. Some embodiments of the present invention may provide one or more benefits or advantages over the prior art.

II. SUMMARY OF THE INVENTION

Embodiments may include a radial forge, comprising: an upper ram having a hydraulically driven platen; a lower platen opposing the upper platen; a master gear having: a face perpendicular to the platen of the upper ram and the platen of the lower ram; a central aperture sized to permit the lower platen and/or the upper platen to pass therethrough; a thrust bearing rotatably supporting the master gear; a drive gear rotatably engaging the master gear; and a radial ram having a hydraulically driven radial platen perpendicular to the upper platen and the lower platen, wherein the radial ram is mounted to the face of the master gear.

According to some embodiments the upper ram, and the radial ram are independently actuatable.

According to some embodiments the lower platen is part of a lower ram and is hydraulically driven, and wherein the lower ram is independently actuatable.

According to some embodiments the master gear and the drive gear are spur gears.

According to some embodiments the thrust bearing is a ball-type thrust bearing.

According to some embodiments the drive gear is driven by a servo.

Embodiments may further include a plurality of radial rams each having a hydraulically driven radial platen perpendicular to the upper platen and the lower platen, wherein the radial ram is mounted to the face of the master gear.

According to some embodiments each of the plurality of radial rams further comprises a die removably mountable to the radial platen of the radial ram.

According to some embodiments each of the plurality of radial rams is mounted to the face of the master gear through a common mounting bracket.

According to some embodiments each of the upper platen, lower platen, and radial platen are mountably co-operable with one or more dies.

Embodiments may comprise a radial forge including an upper ram having a hydraulically driven platen; a lower ram having a hydraulically driven platen opposing the upper platen; a master gear having: a face perpendicular to the upper platen and the lower platen; a central aperture sized to permit the lower platen and/or the upper platen to pass therethrough; a thrust bearing rotatably supporting the master gear; a drive gear rotatably engaging the master gear; a plurality of radial rams each having a hydraulically driven radial platen perpendicular to the upper platen and the lower platen, wherein the plurality of radial rams are mounted to the face of the master gear, and wherein the upper ram, lower ram, and each of the plurality of radial rams are independently actuatable; and each of the plurality of radial rams, the top ram, and the bottom ram are mountably co-operable with one or more dies.

Other benefits and advantages will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof, wherein like reference numerals indicate like structure, and wherein.

IV. DETAILED DESCRIPTION OF THE INVENTION

As used herein the terms "embodiment", "embodiments", "some embodiments", "other embodiments" and so on are not exclusive of one another. Except where there is an explicit statement to the contrary, all descriptions of the features and elements of the various embodiments disclosed herein may be combined in all operable combinations thereof.

Language used herein to describe process steps may include words such as "then" which suggest an order of operations; however, one skilled in the art will appreciate that the use of such terms is often a matter of convenience and does not necessarily limit the process being described to a particular order of steps.

Conjunctions and combinations of conjunctions (e.g. "and/or") are used herein when reciting elements and characteristics of embodiments; however, unless specifically stated to the contrary or required by context, "and", "or" and "and/or" are interchangeable and do not necessarily require every element of a list or only one element of a list to the exclusion of others.

Terms of degree, terms of approximation, and/or subjective terms may be used herein to describe certain features or elements of the invention. In each case sufficient disclosure is provided to inform the person having ordinary skill in the art in accordance with the written description requirement and the definiteness requirement of 35 U.S.C. 112.

Figure 1:
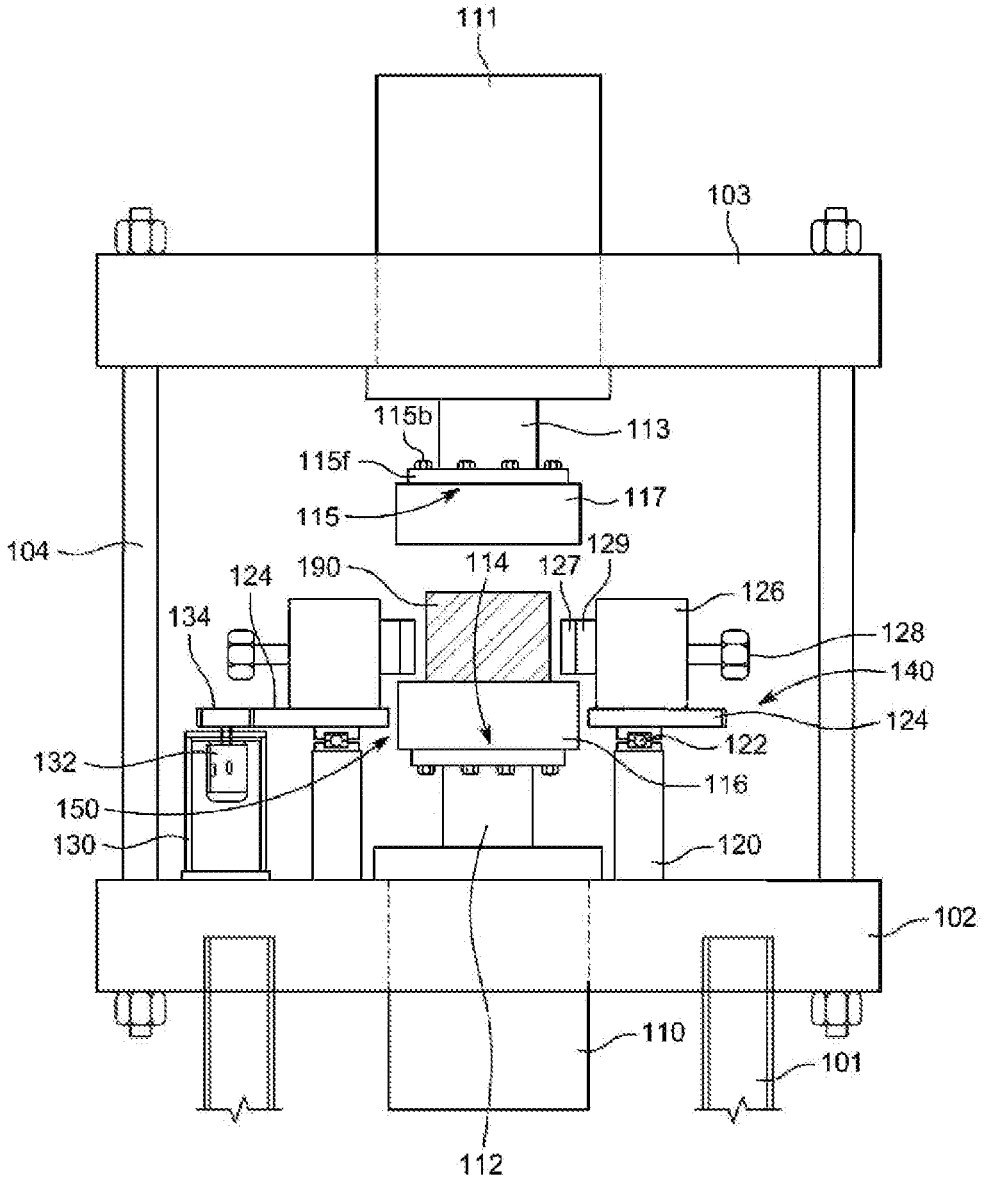
FIG. 1 is a is a partial cross-sectional front view of an embodiment.

Referring now to the drawings wherein the showings are for purposes of illustrating embodiments of the invention only and not for purposes of limiting the same, FIG. 1 is a view of a forge embodiment 100 with part of the master gear 124 cut away to reveal inner structures surrounding a billet workpiece 190. The embodiment 100 includes a frame comprising an upper frame 103 and a lower frame 102 joined with tie rods 104. The lower frame 102 may be supported with legs 101 or any structure suitable for stabilizing and bearing the weight of the forge 100. The upper frame 103 supportably receives an upper double acting hydraulic cylinder 111 including an upper ram 113. The upper hydraulic cylinder 111 is directed downwardly so that thrusting the ram 113 causes the ram 113 to extend downwardly. The ram 113 includes a platen 115 to which may be mounted an upper die 117. Thus, the upper ram 113, platen 115, and die 117 are hydraulically driven.

The upper die 117 may be removably mounted to the upper platen 115, i.e. the upper platen 115 may be mountably co-operable with the upper die 117. For example, and without limitation, the platen 115 of the illustrated embodiment may include a flange 115*f* with through-holes for mounting a die with bolts 115*b*. The upper die 117 illustrated in FIG. 1 is a flat open die; however, the person having ordinary skill in the art will readily appreciate that any suitable die may be attached to the platen 115.

Similar to the upper frame 103, the lower frame 102 supportably receives a second double acting hydraulic cylinder 110. The lower hydraulic cylinder 110 is directed upwardly so that the thrusting action of the lower ram 112 causes the lower ram to extend upward. Similar to the upper cylinder 111, the lower cylinder 110 includes a hydraulically driven lower ram 112 and a platen 114 mountably co-operable with a die 116. A billet workpiece 190 is shown disposed on the lower die 116. As shown in FIG. 1, the upper and lower rams 113, 112 oppose each other, the rams being aligned so that the platens 114, 115 can impinge upon each other. In the illustrated embodiment, the lower ram 112 is hydraulically driven like the upper ram 113; however, this is optional. Particularly, in other embodiments, the lower ram 112 may not be driven. Rather the ram of the lower cylinder 110 may be statically locked in place, or the lower cylinder 110 including the ram 112 may be replaced with a static platen or anvil. As used herein for purposes of describing and claiming the invention, the meaning of the word ram includes static platens and anvils.

With continuing reference to FIG. 1, a gantry 140 comprises master gear 124, which is shown supporting a pair of radially oriented double acting hydraulic cylinders 126. The major faces of the master gear 124 are horizontally oriented, and therefore perpendicular to the travel of the upper and lower platens 114, 115. A front section of the master gear is omitted in this drawing to show the relationship between the master gear 124, radial cylinders 126, and workpiece 190. The radial cylinders 126 are mounted to the top major face of the master gear 124 according to known means and include inwardly directed rams 129 mountably co-operable with radial die segments 127*s*.

The master gear 124 further includes a central aperture 150 which is sized to allow the upper and lower platens 114, 115 and/or dies mounted to the platens, to pass through the aperture 150 and impact a workpiece 190. Accordingly, the workpiece 190 can be impacted from the top, bottom, and from any radial direction. Moreover, the master gear 124 is supported from underneath by a circular thrust bearing 122, such as a ball-type thrust bearing, mounted to the lower frame 102 on a circular mount 120. Thus, the master gear 124 is free to rotate, and may be rotationally driven by a drive gear 134. In the illustrated embodiment the master gear 124 and the drive gear 134 are spur gears; however, the person having ordinary skill in the art will readily appreciate that the invention is not limited to spur gears. Any gear suitable for driving rotation of a master gear may be substituted without departing from the scope of the invention. The master gear 124 and drive gear 134 being spur gears in the illustrated embodiment, the drive gear 134 rotatably engages the master gear 124 by meshing radially directed cogs with complementary cogs of the master gear 124.

Figure 2:
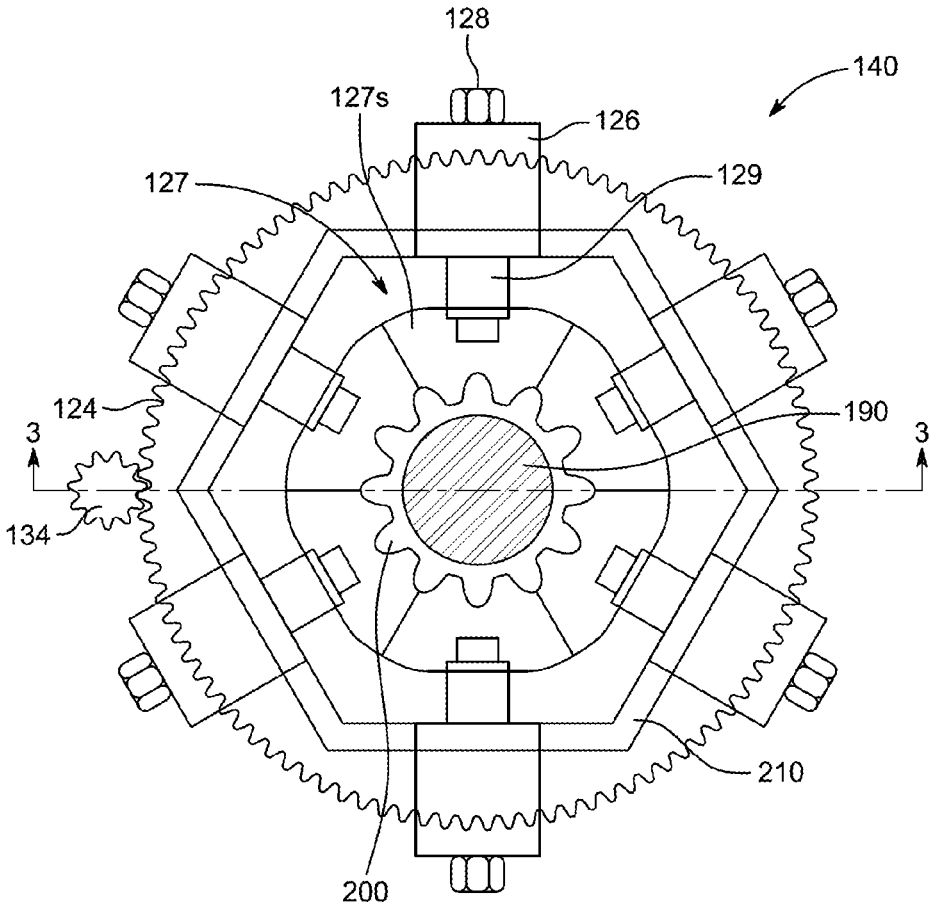
FIG. 2 is a top view of a gantry according to FIG. 1.

Turning to FIG. 2, a top view of the gantry 140 is shown in relation to the drive gear 134. The drive gear 134 is shown rotatably engaging the master gear 124, whereby the cogs of the drive gear 134 mesh with the cogs of the master gear 124. The central aperture 150 is obstructed from view by radial die segments 127*s* and the workpiece 190. The radial die segments 127*s* are shown mounted to radial rams 129 according to known means which are not shown. The radial rams 129 are a component of a double acting hydraulic cylinder 126. The cylinders 126 include inwardly directed rams 129, which include nuts 128 at one end that function as a mechanical stop to limit the range of linear motion of the ram 129. As will be discussed in more detail below, spacers may be installed on the ram 129 between the nut 128 and the cylinder 126 housing to further limit its range of motion.

With continuing reference to FIG. 2, the billet workpiece 190 is centrally located within the radial die 127. The radial die 127 is divided into segments 127*s* where each segment is mounted to a radial ram 129. As shown in FIG. 2, the rams 129 are fully extended, bringing the die segments into contact with each other thus forming a radially closed die 127 with the top remaining open. A gap 200 remains between the workpiece 190 and the closed radial die 127. The workpiece 190 will flow, filling the gap 200, when compressed by the upper and lower dies 117, 116.

Also shown in FIG. 2, the radial hydraulic cylinders 126 are mounted to the master gear 124 through a common mounting bracket 210. The bracket 210 is advantageously hexagonal in shape to accommodate six radial hydraulic cylinders 126; however, the invention is not limited to six radial hydraulic cylinders 126, but rather may include anywhere from one cylinder 126 to as many as can be operably placed radially about a workpiece 190. Advantageously, embodiments may comprise pairs of diametrically opposed radial hydraulic cylinders. Regardless of number, each radial cylinder 126 can be independently and/or collectively actuated according to a predetermined program or manual trigger.

Figure 3:
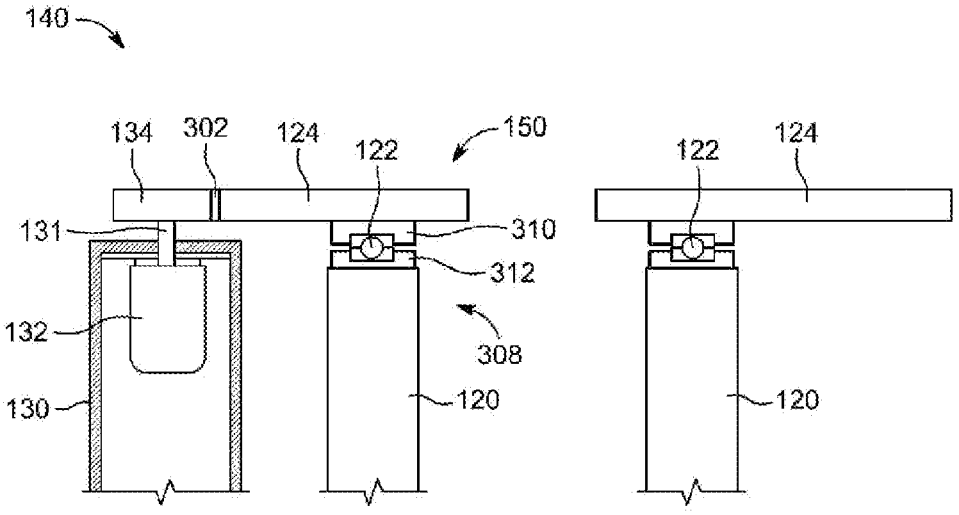
FIG. 3 is a cross sectional view of the gantry of FIG. 2 taken along line 3-3.

FIG. 3 is a cross section of the gantry 140 shown in FIG. 2 taken along line 3-3. The gantry 140 includes the master gear 124 and drive gear 134 which mesh at line 302. The drive gear provides a rotational driving force to the gantry 140 through servo motor 132. The servo 132 is mounted to the lower frame 102 (not shown) through mounting bracket 130 and communicates rotational force to the drive gear 134 through shaft 131. The master gear 124 has freedom to rotate because it is mounted on a thrust bearing 308 including ball bearings 122, and upper and lower races 310, 312. The races 310, 312 sweep out a circular track supported by circular mount 120; however, like the master gear 124, only a cross section of the races 310, 312 and circular mount 120 is shown in FIG. 3. Accordingly, the gantry 140 is capable of positioning the radial hydraulic cylinders 126 in any desired radial position about the workpiece 190.

Figure 4:
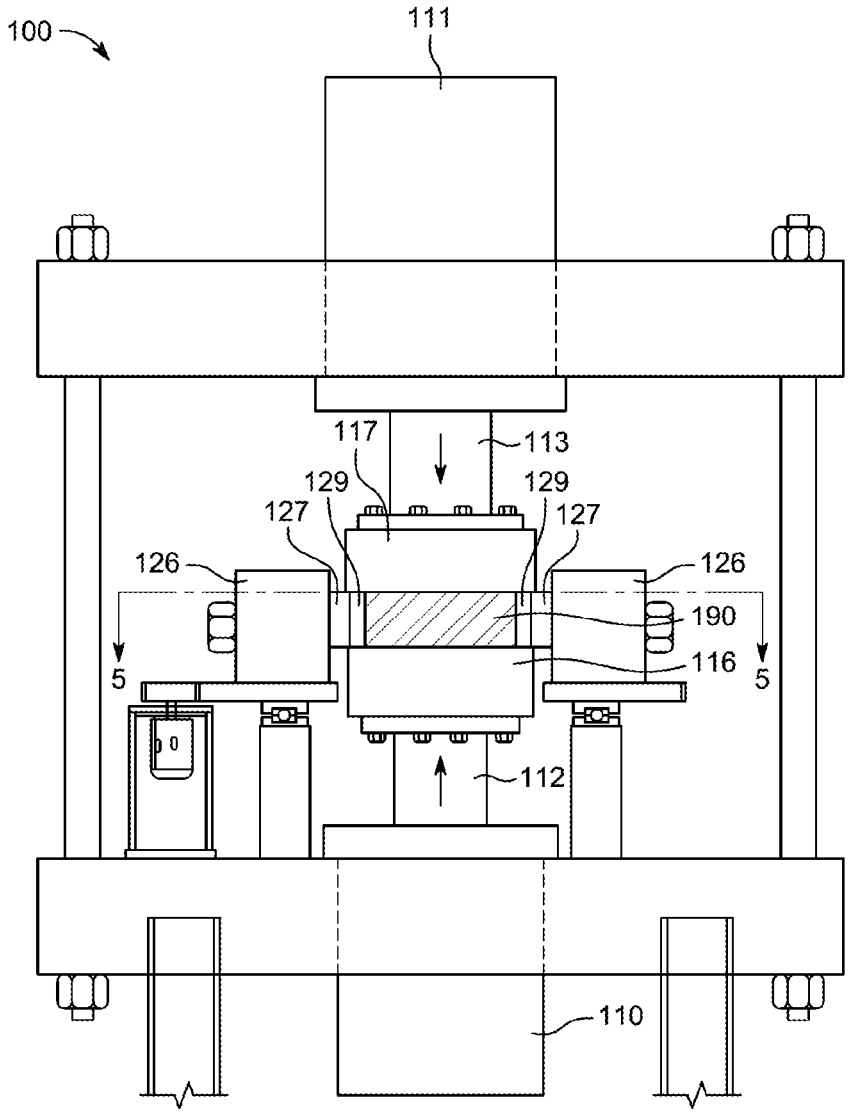
FIG. 4 is a partial cross-sectional front view of an embodiment.
Figure 5:
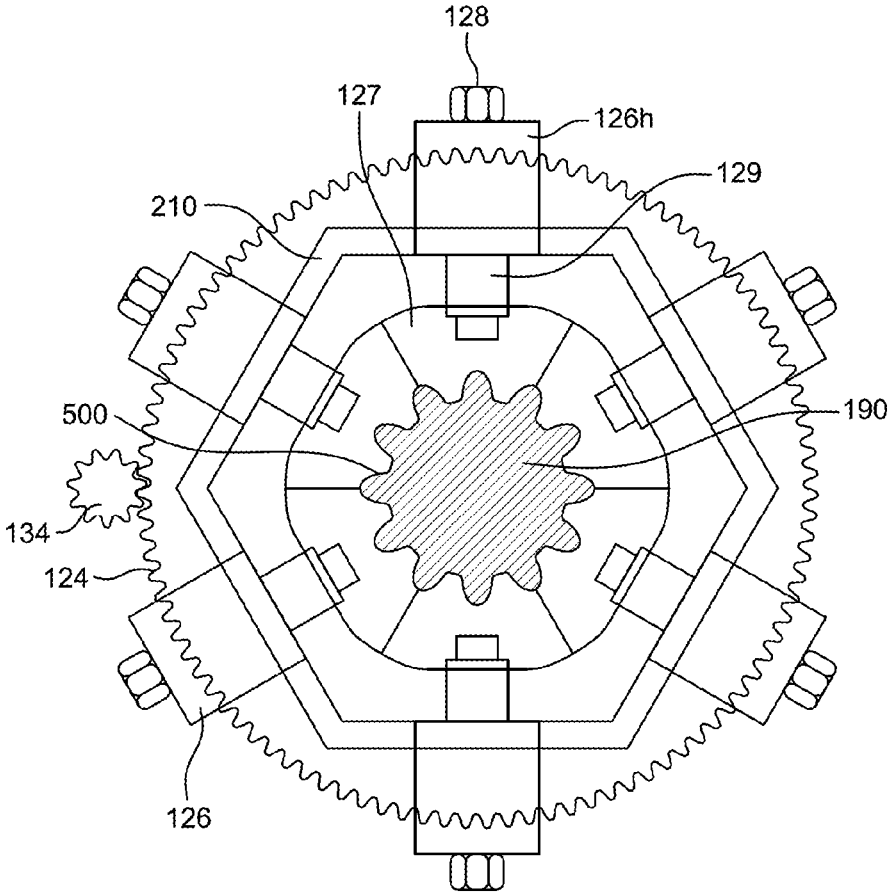
FIG. 5 is a top view of the gantry of FIG. 4 taken along line 5-5.

Turning to FIG. 4, the embodiment 100 is shown where the upper cylinder 111, lower cylinder 110, and radial cylinders 126 are all extended, maximally compressing the workpiece 190 in a now fully closed die having upper 117, lower 116, and segmental radial 129 die components. FIG. 5 is a top view of the workpiece 190 and taken from the vantage indicated by line 5-5 in FIG. 4. The workpiece 190 is shown completely filling the closed radial die 127 and contacting the radial die 127 at interface 500. As drawn in FIG. 5, the rams 129 of the radial hydraulic cylinders 126 are fully extended with the mechanical stop nut 128 abutting a housing 126*h* of the cylinder 126. Importantly, embodiments may also include spacers interposable between the housing 126*h* and the stop nut 128 to adjust the travel of the radial rams 129.

Figure 6:
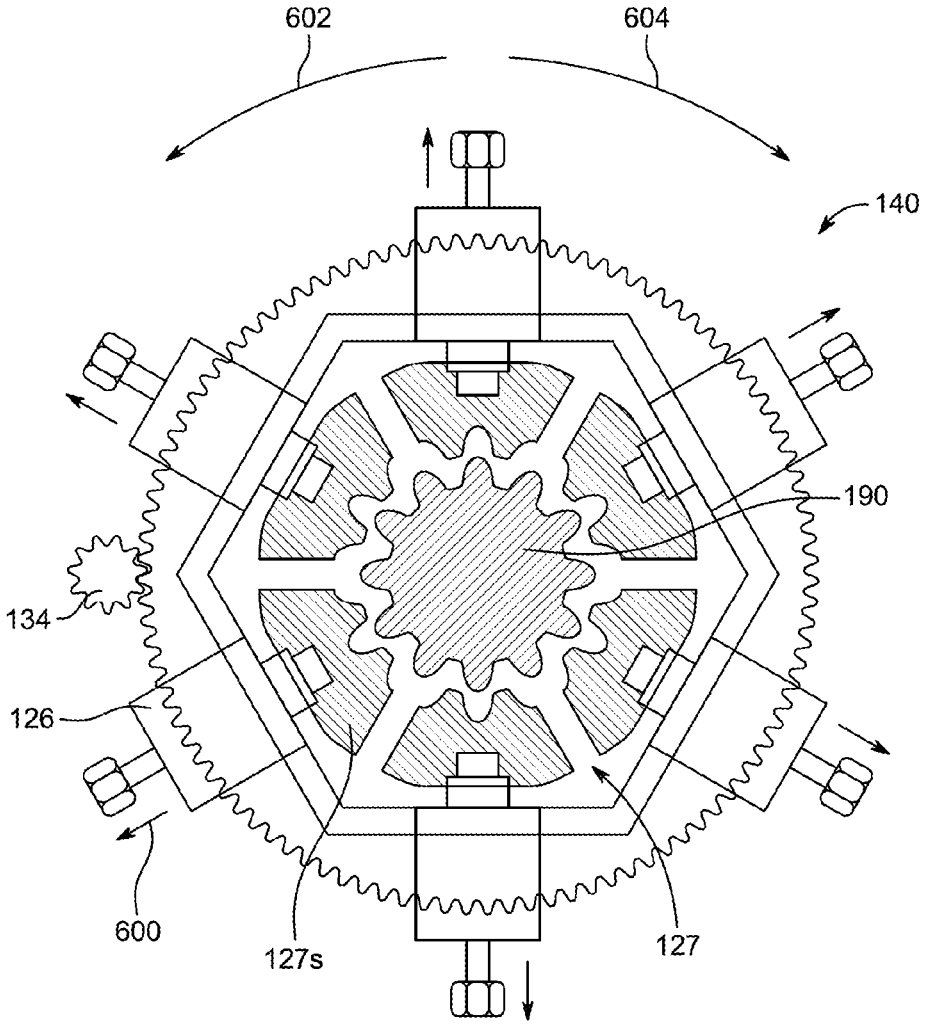
FIG. 6 is a top view the gantry of FIG. 5 in an open configuration.

FIG. 6 is the same as FIG. 5 except that the radial die segments 127*s* have been withdrawn. The segmental radial die 127 may be opened by reversing 600 the radial hydraulic cylinders 126. On both the compression stroke and return stroke the radial hydraulic cylinders 126 may be independently or simultaneously actuated. In other words, strokes may be in unison or in series according to any necessary or convenient program. Similarly, the strokes of the radial hydraulic cylinders 126 may be in unison or in series with the upper and/or lower cylinders 111, 110.

With continuing reference to FIG. 6, the drive gear 134 may drive rotation 602, 604 of the gantry 140 through master gear 124. Accordingly, the gantry 140 may reposition 602, 604 the radial hydraulic cylinders 126 about the workpiece 190 and strike again from a different angular position.

Figure 7:
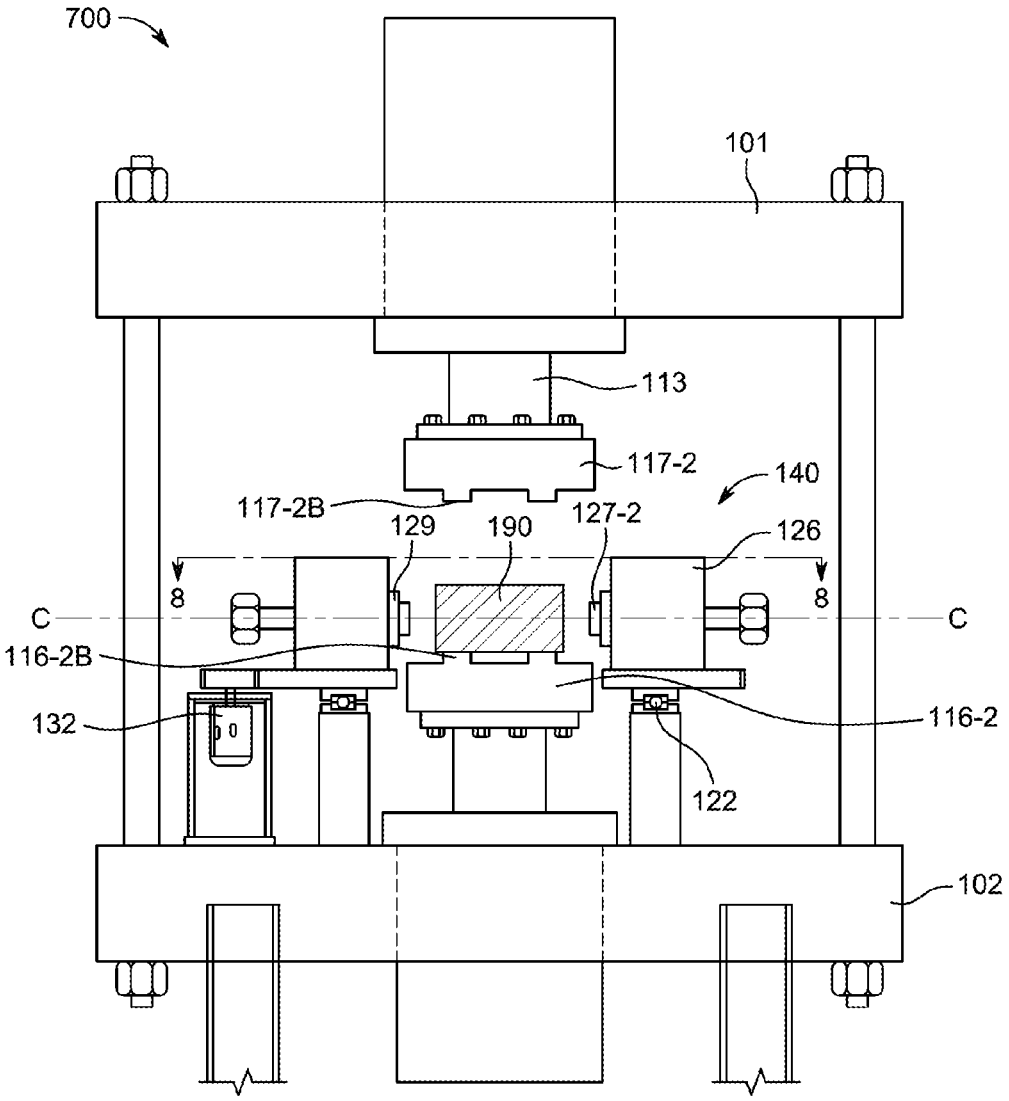
FIG. 7 is a is a partial cross-sectional front view of an embodiment.
Figure 8:
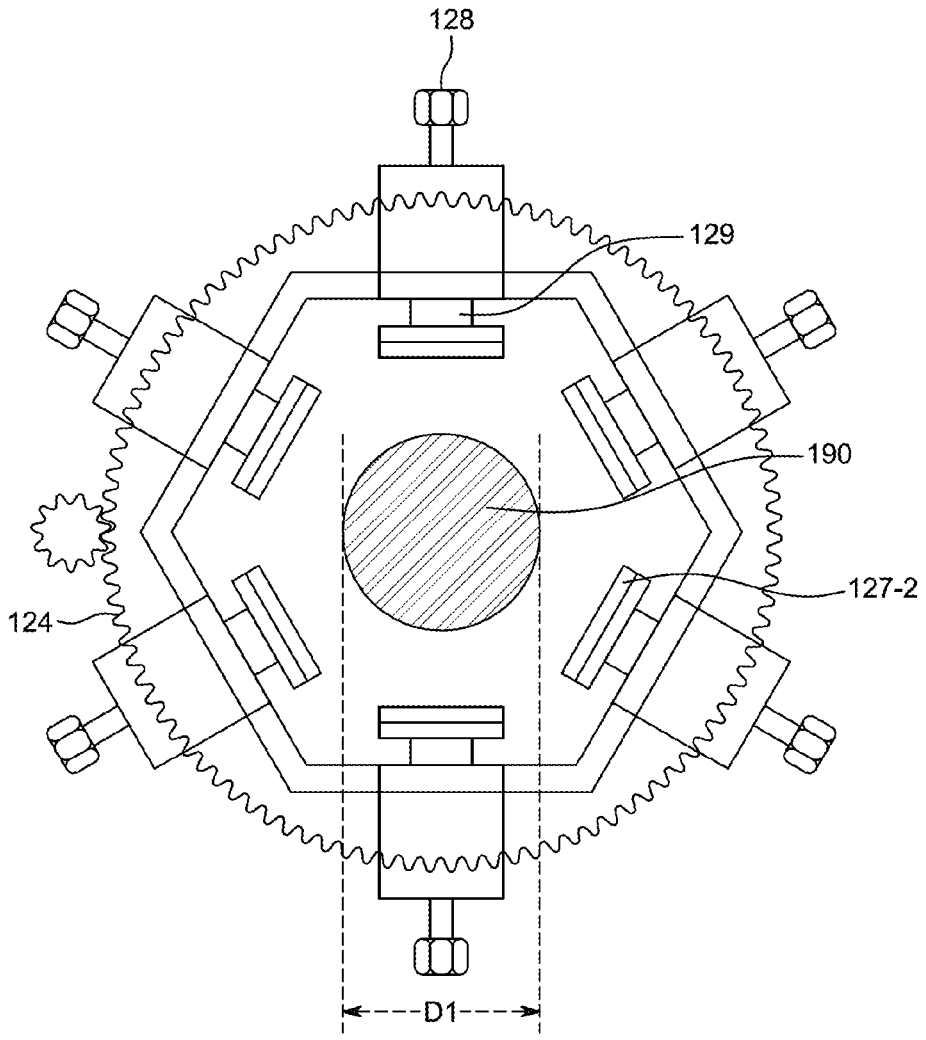
FIG. 8 is a top view of a gantry holding a billet prior to compression.

Turning to FIGS. 7 and 8, a second embodiment 700 is shown which is identical in all respects to embodiment 100 except that it includes different upper 117-2, lower 116-2, and radial 127-2 dies. In this embodiment 700 the dies are particularly adapted to forging a crane wheel with a circumferential groove. Similar to FIG. 1, FIG. 7 is a partial cross-sectional view showing the gantry 140 and dies 117-2, 116-2, 127-2 in cross section. The embodiment 700 is drawn in FIG. 7 with the upper ram 113 and radial rams 129 retracted from the workpiece 190. The lower ram 112 is locked in position at one half the thickness of the finished crane wheel below the center line C-C of the radial dies 127-2. Circular bosses 117-2B, 116-2B are shown on the upper die 117-2 and lower die 116-2. Though circular, the bosses 117-2B, 116-2B each appear as two spaced-apart rectangular bosses because the view is cross sectional. FIG. 8 provides a top view of the gantry 140 shown in FIG. 7 from the vantage point of line 8-8. The rams 129 are shown retracted away from the billet workpiece 190, and fitted with two-tiered flat dies 127-2. The billet is uncompressed and therefore has a smaller diameter, D1, than it will after compression (D2 in FIG. 10).

Figure 9:
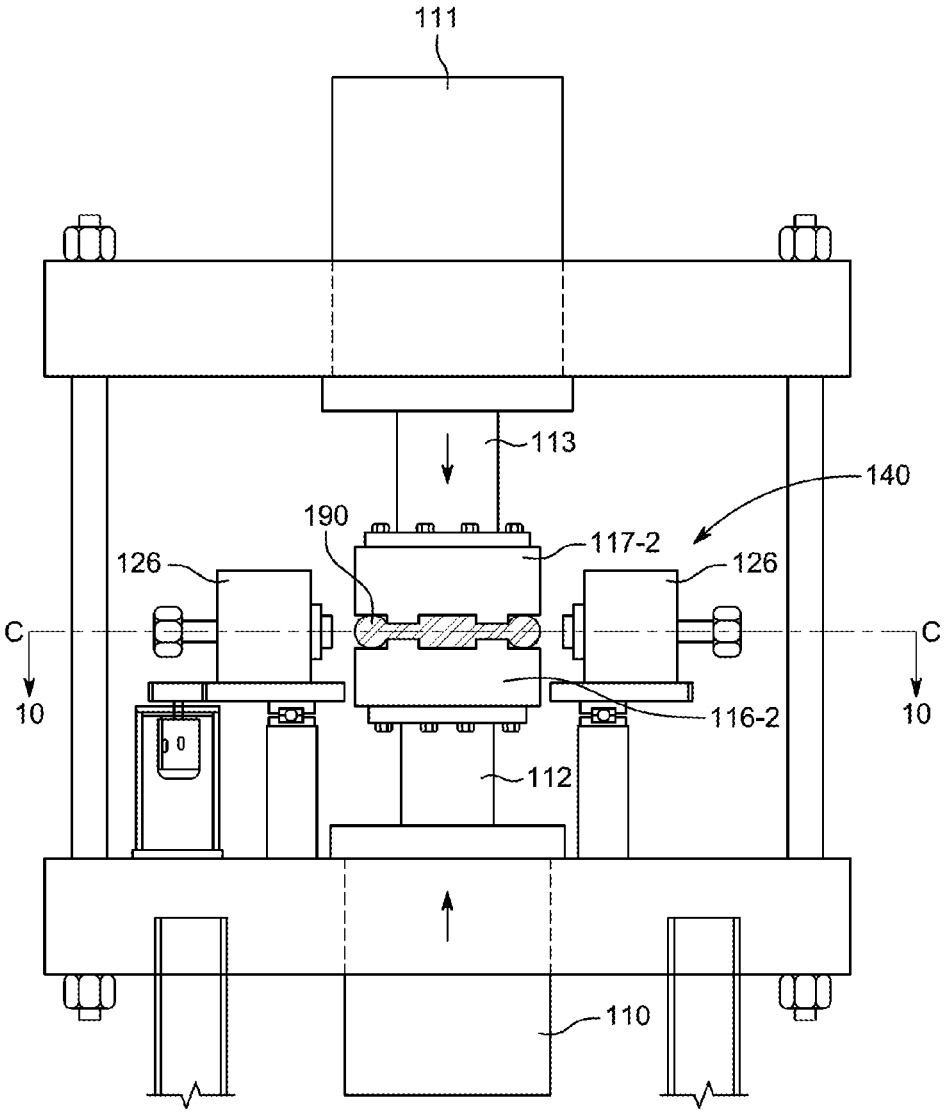
FIG. 9 is a partial cross-sectional front view of an embodiment.
Figure 10:
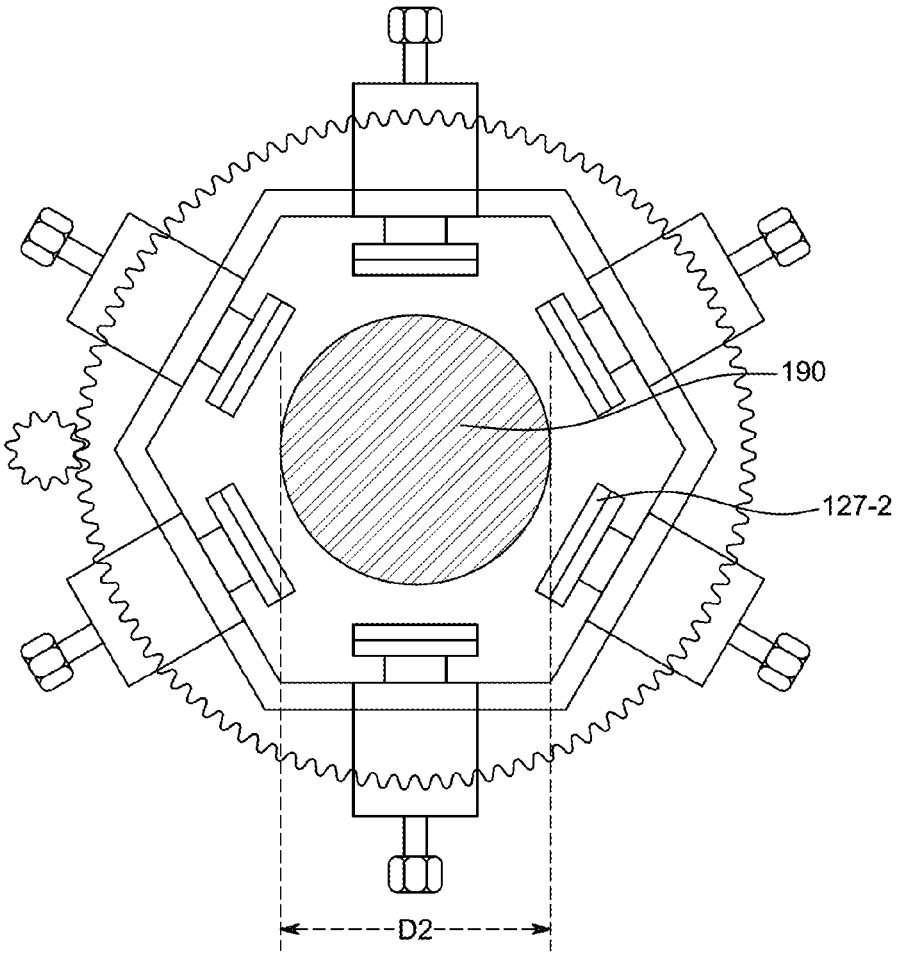
FIG. 10 is a top view of a gantry holding a billet after compression.

FIG. 9 shows the embodiment 700 of FIG. 7 where the upper ram 113 and lower ram 112 are actuated, and their respective dies 117-2, 116-2 are compressing the billet workpiece 190. The radial rams 129 remain retracted at this step of the forging process. FIG. 10 is a top view of the gantry 140 taken along line 10-10 as drawn in FIG. 9. Line 10-10 overlays line C-C, indicating the centerline of the radial dies 127-2. The workpiece 190 is shown compressed by the upper die 117-2 and the lower die 116-2. Now compressed, the workpiece 190 has a larger diameter D2. The radial dies 127-2 remain retracted as shown in FIGS. 9 and 10.

Figure 11:
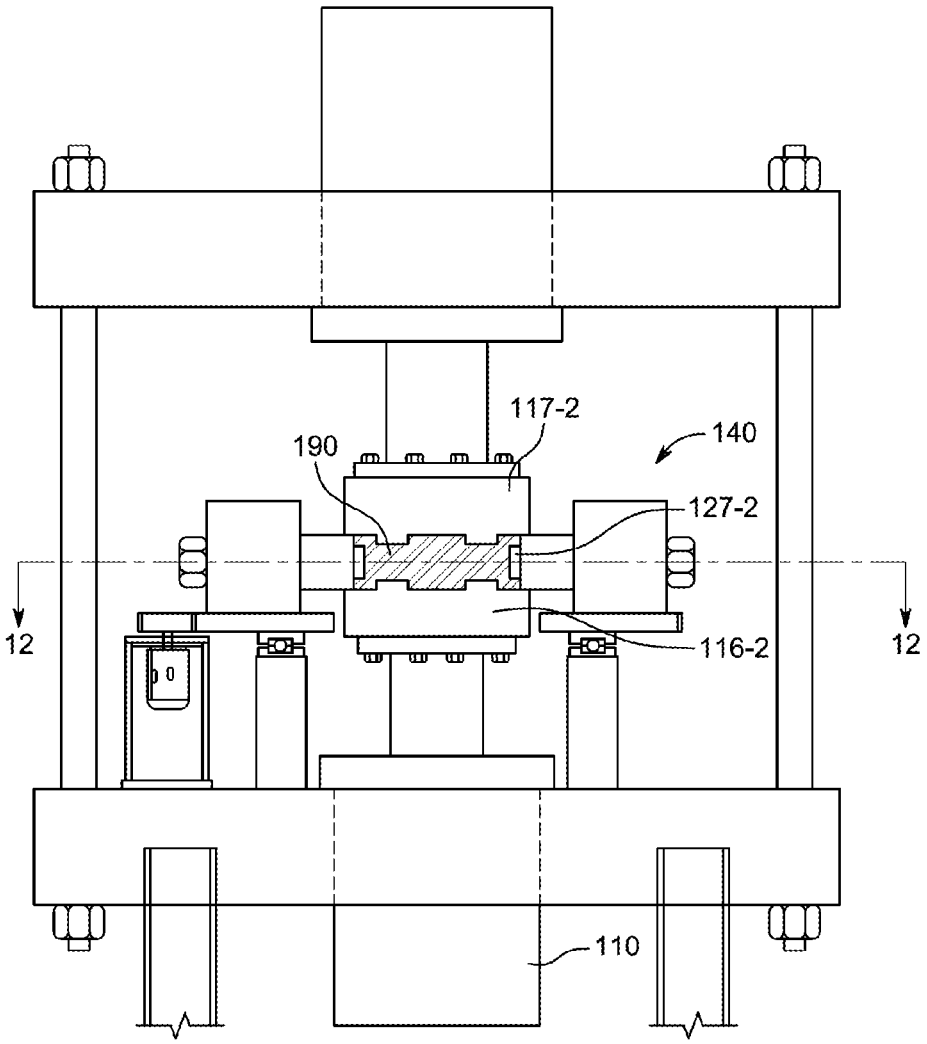
FIG. 11 is a partial cross-sectional front view of an embodiment.
Figure 12A:
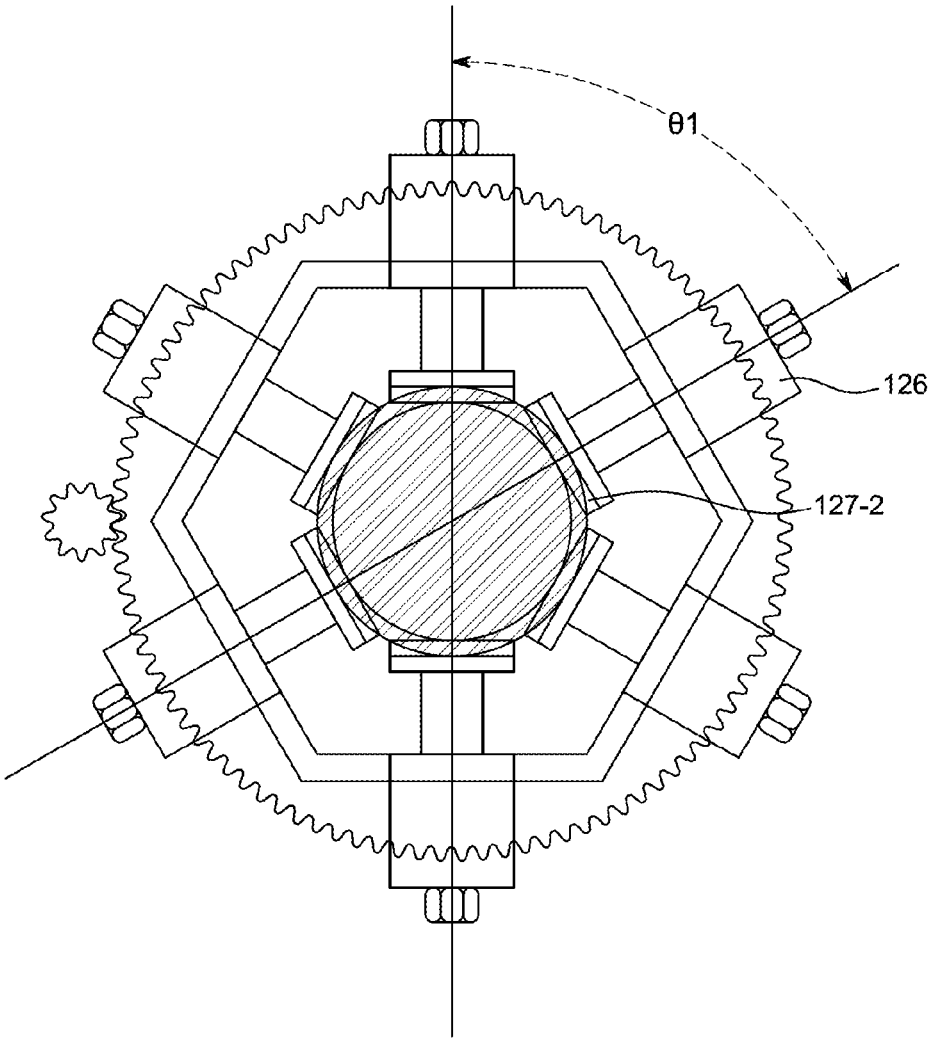
FIG. 12A is a top view of a gantry with the dies closed in a first rotational position.
Figure 12B:
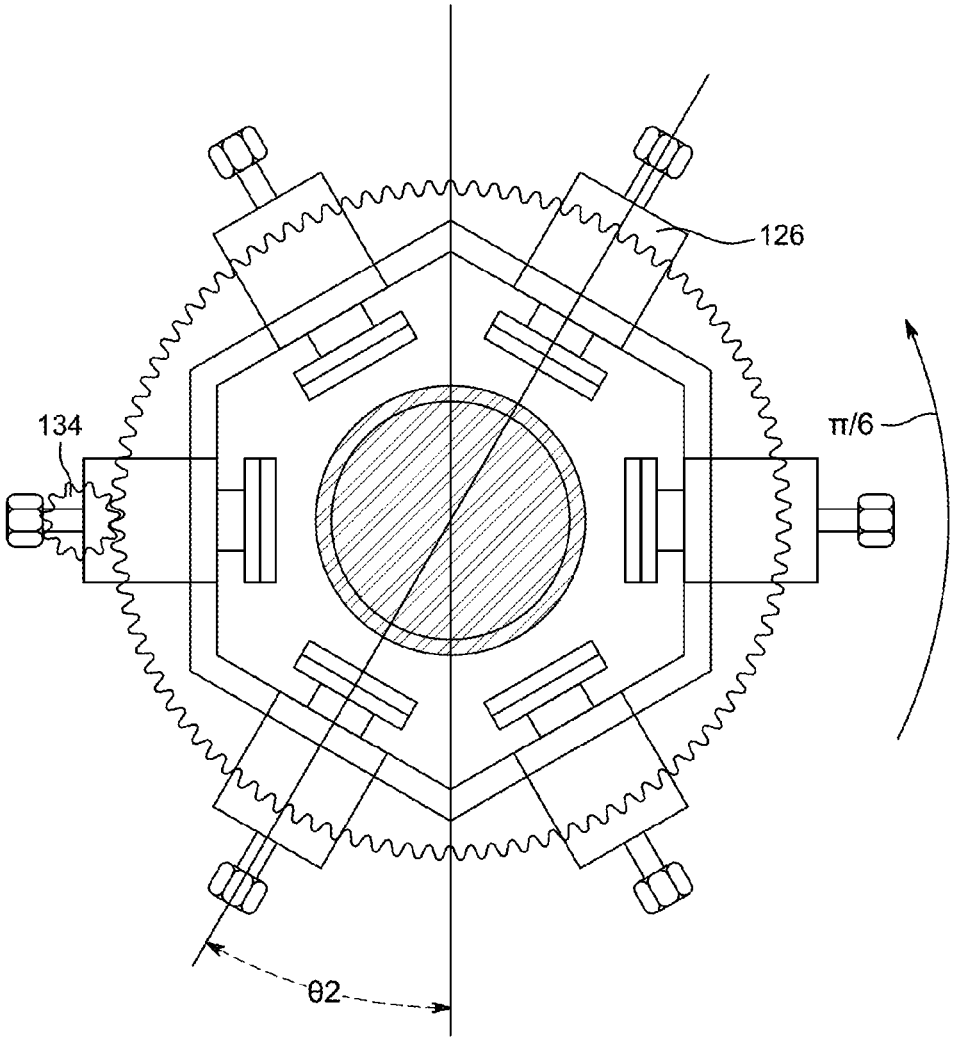
FIG. 12B is top view of a gantry with the dies open in a second rotational position.

Turning to FIG. 11, the embodiment 700 is shown with the upper die 117-2, lower die 116-2 and radial dies 127-2 all compressing the workpiece 190. The two-tiered radial dies 127-2 are shown forming the circumferential groove of the crane wheel. FIGS. 12A and 12B show a top view of the gantry 140 taken along line 12-12 of FIG. 11. In FIG. 12A the radial dies 127-2 all strike the billet 190 in unison. One particular radial hydraulic cylinder 126, indicated by the lead line and reference numeral "126", is in a first radial position at angle θ1 relative to the illustrated axis. In FIG. 12B the indicated hydraulic cylinder 126 moves π/6 radians counterclockwise to position θ2 relative to the same axis. The rotational motion of the gantry is driven by drive gear 134. Thus, the embodiment can repeatedly strike the billet 190, rotate the gantry 140 about the billet 190 to a new angular position θ, and strike the billet 190 again until the desired form is achieved, at which point the dies may be opened and the finished workpiece 190 may be removed from the embodiment 700.

Figure 13A:
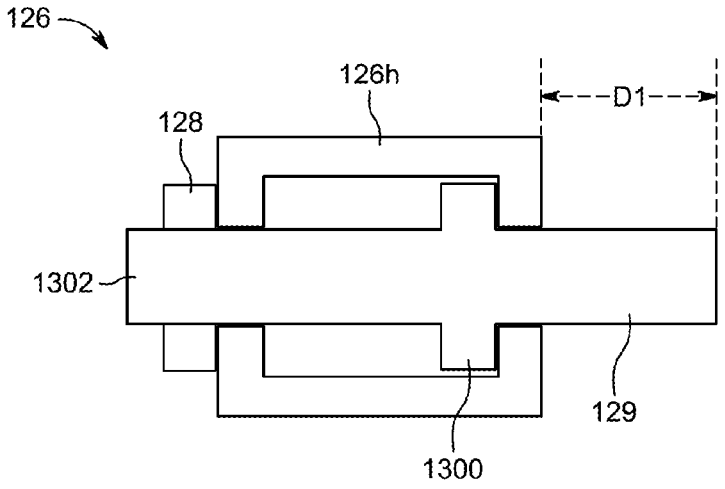
FIG. 13A is a cross-sectional view of a radial hydraulic cylinder without a spacer installed.
Figure 13B:
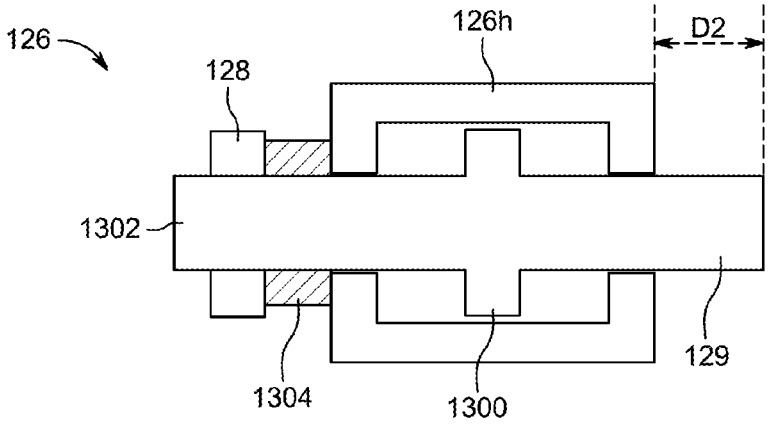
FIG. 13B is a cross-sectional view of a radial hydraulic cylinder with a spacer installed.

FIG. 13A is a cross-sectional view of a radial hydraulic cylinder 126 without a spacer installed, and FIG. 13B shows the same hydraulic cylinder with a spacer 1304 installed. The spacer 1304 serves to restrict the range of motion of the radial ram(s) 129 and therefore adjust the radial size of the workpiece. The spacer 1304 is installed on the piston 1302 between the nut 128 and the housing 126*h* of the radial hydraulic cylinder 126. As shown in FIG. 13A, an internal mechanical stop 1300 and the stop nut 128 cooperate to define the maximum extension of the ram 129 in the absence of a spacer 1304. The nut 128 may be adjustable to some degree. For instance, the nut 128 may include female threads, and the piston 1302 may include male threads thereby allowing a continuous adjustment by turning the nut 128 clockwise or counterclockwise. However, as shown in FIG. 13B a spacer may be used to in addition to or instead of a threaded stop nut 128. The effect of adding spacer 1304 is illustrated in that the maximum extension D1 shown in FIG. 13A is reduced in FIG. 13B to D2.

It will be apparent to those skilled in the art that the above methods and apparatuses may be changed or modified without departing from the general scope of the invention. The invention is intended to include all such modifications and alterations insofar as they come within the scope of the appended claims or the equivalents thereof.

The following list shows the correlation between the various reference numerals used in the appended drawings, and the elements of the drawings that they represent. This list is provided only for convenience and is not intended to be limiting in any way. Abbreviated, shortened, or otherwise somewhat different wording may be used herein to describe the same structures or drawing elements without obscuring their meaning to the person having ordinary skill in the art.

I claim:

1. A radial forge, comprising:

an upper ram having a hydraulically driven upper platen;

a lower platen opposing the upper platen;

a master gear having:

a face perpendicular to the upper ram, and a central aperture sized to permit the lower platen and/or the upper platen to pass therethrough;

a thrust bearing rotatably supporting the master gear;

a drive gear rotatably engaging the master gear; and at least one radial hydraulic cylinder each having a radial ram and a radial platen perpendicular to the upper platen and the lower platen, wherein the at least one radial hydraulic cylinder is mounted to the face of the master gear.

2. The radial forge of claim 1, wherein the upper ram, and the radial ram are independently actuatable.

3. The radial forge of claim 1, wherein the lower platen is part of a lower ram and is hydraulically driven, and wherein the lower ram is independently actuatable.

4. The radial forge of claim 1, wherein the master gear and the drive gear are spur gears.

5. The radial forge of claim 1, wherein the thrust bearing is a ball-type thrust bearing.

6. The radial forge of claim 1, wherein the drive gear is driven by a servo.

7. The radial forge of claim 1, further comprising a plurality of radial hydraulic cylinders each having a radial ram with a radial platen perpendicular to the upper platen and the lower platen, wherein each of the plurality of radial hydraulic cylinders is mounted to the face of the master gear.

8. The radial forge of claim 7, wherein each of the plurality of radial hydraulic cylinders further comprises a die removably mountable to the radial platen.

9. The radial forge of claim 8, wherein each of the plurality of radial hydraulic cylinders is mounted to the face of the master gear through a common mounting bracket.

10. The radial forge of claim 1, wherein each of the upper platen, lower platen, and radial platen are mountably co-operable with a die or a die segment.

11. A radial forge, comprising:

an upper ram having a hydraulically driven upper platen;

a lower ram having a hydraulically driven lower platen opposing the upper platen;

a master gear having:

a face perpendicular to the upper ram and the lower ram;

a central aperture sized to permit the lower platen and/or the upper platen to pass therethrough;

a thrust bearing rotatably supporting the master gear;

a drive gear rotatably engaging the master gear; and a plurality of radial hydraulic cylinders each having a radial ram with a radial platen perpendicular to the upper platen and the lower platen, wherein each of the plurality of radial hydraulic cylinders is mounted to the face of the master gear, and wherein the upper ram, lower ram, and each of the plurality of radial rams are independently actuatable;

wherein each of the upper platen, the lower platen, and the plurality of radial platens are mountably co-operable with a die or a die segment.

* * * * *